United States Patent [19]

Tsuji et al.

[11] 3,952,173

[45] Apr. 20, 1976

[54] SWITCHING APPARATUS

[75] Inventors: Takehiro Tsuji; Katsuyuki Takagi, both of Aichi, Japan

[73] Assignee: Kabushiki Kaisha Tokai Rika Denki Seisakusho, Aichi, Japan

[22] Filed: Oct. 22, 1974

[21] Appl. No.: 516,924

[30] Foreign Application Priority Data

Nov. 9, 1973 Japan ..... 48-130262[U]

[52] U.S. Cl. ..... 200/264; 200/159 B

[51] Int. Cl.[2] ..... H01H 1/02

[58] Field of Search ..... 200/264, 159 B, 159 R; 338/100, 114, 118, 2

[56] References Cited

UNITED STATES PATENTS 3,509,296 4/1970 Harshman et al. ..... 200/46

3,696,408 10/1972 Bouchard et al. ..... 200/264 X 3,758,733 9/1973 Durocher et al. ..... 200/264 X

*Primary Examiner*—Herman J. Hohauser

*Attorney, Agent, or Firm*—Elliott I. Pollock

[57] ABSTRACT

A two-stroke switch to be actuated by two stroke operations comprises a first stationary terminal, a second stationary terminal, a contact element of conductive elastomeric material for establishing a current path between the first and second terminals, and an actuating member provided with a moving terminal for imparting a compressing force to the contact element. When the actuating member is first manipulated to compress the contact element axially thereof, the contact element is rendered electrically conductive, and when the actuating member is secondly manipulated to further compress the contact element which is then enlarged radially thereof, the contact element may be electrically connected to the first and/or second terminals thereby turning on the switch.

5 Claims, 3 Drawing Figures

SWITCHING APPARATUS

BACKGROUND OF THE INVENTION

The present invention relates to an improved switching apparatus, and more particularly to a switching apparatus, operable by two stroke actions, which includes a contact element of conductive elastomeric material that is non-conductive in a non-compressed state but is rendered electrically conductive when it is compressed.

The switching apparatus of the present invention is a switch of two-stroke type which turns on and off an electrical connection between two or more terminals by means of an actuating member which is mechanically operated to first compress the contact element axially thereof and secondly compress the contact element further which is then enlarged radially thereof for finalizing the current path.

There are known a variety of switches of the type specified. In a conventional switch structure of this type, a moving member acts as a moving contact, and the switch is placed in the "on" position when the moving contact is brought into contact with the terminals, whereas the switch is placed in the "off" position when the moving contact is moved away from the terminals. This switch structure has disadvantages from the aspects of long-time service and mechanical property, since it is not suitable for use in applications where the frequency of on-off operations is quite high, and is therefore relatively short-lived. This is because permanent deformation due to fatigue easily takes place in the moving contact during the repeated use thereof, and an arc jumps across the moving contact and the terminals when the switch is turned off.

The conventional switch structure is also disadvantageous from the manufacturing aspect, since the switching action cannot be reliably attained when the moving contact is mounted in an incorrect position during assembling. This therefore calls for machining and assembling of high precision for the switching apparatus.

SUMMARY OF THE INVENTION

The present invention provides a switching apparatus of the type which is actuated by two stroke actions, comprising a switch casing, a holder provided with an elastic mat of electrically insulating material therein and fixed to the switch casing, two terminals rigidly disposed in the holder, one of said two terminals being of hollow cylindrical shape and out of contact with the other, a contact element of electrically conductive elastomeric material disposed normally in a non-compressed state but engageable with either one of the two terminals, and an actuating member provided with a moving terminal which is disposed within the switch casing and is operable by two stroke operations to first compress the contact element in the axial direction thereof for rendering the contact element electrically conductive, and secondly compress the contact element further which is then enlarged in the radial direction thereof for finalizing a current path between the two terminals.

The contact element is made by dispersing fine particles of conductive metal in a mass of non-conductive elastomer such as silicone rubber, and the on-off operation of the switch is controlled by merely compressing the contact element by means of the actuating member or releasing the compressing force from the contact element by the actuating member.

It is therefore one object of the present invention to provide a switching apparatus of the type which is actuated by two stroke operations for the on-off operation between terminals.

It is another object of the present invention to provide a switching apparatus which includes a contact element of electrically conductive elastomeric material, and a manual actuating member operable by two strokes to first compress the contact element axially thereof and secondly compress the contact element further which is then enlarged radially thereof for finalizing an electrical connection between the terminals.

Other objects and advantages of the present invention will clearly be understood from the following detailed description and accompanying drawings of the present invention.

DESCRIPTION OF THE PREFERRED EMBODIMENTS

Now, the present invention will further be described by way of example only by reference to the accompanying drawings.

Figure 1:
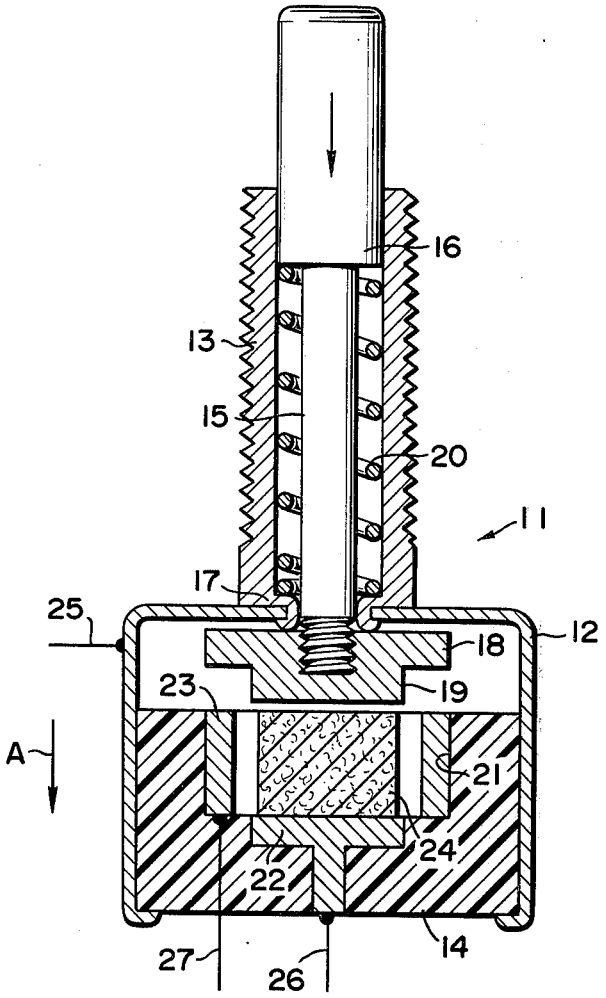
FIG. 1 is a vertical sectional front elevational view of a switching apparatus embodying the present invention.

Referring first to FIG. 1, a switch casing 11 is provided which has a holder 12 fixed to the bottom thereof, and a member 13 of cylindrical shape extends upwardly and centrally thereof is provided with an opening for an actuating member 15 which is slidably inserted into the opening of said member 13. An electrically insulating elastic mat 14 of material such as sponge rubber is superposed on the holder 12.

A moving electrode 18 of a diametrically greater size is rigidly secured to the lower end of said actuating member 15, and has its surfaces exposed in the holder 12. A compression coil spring 20 is provided for loading the actuating member 15 between the diametrically greater upper portion 16 of the member 15 and the diametrically smaller portion 17 of the member 13, and urges the member 15 and the moving electrode 18 in the reverse direction to that indicated by arrow a. The moving electrode 18 is provided with a projection 19 of a diametrically smaller size and concentric therewith. The switch casing 11 is made of electrically conductive metal, and is electrically connected with the moving electrode 18 through the actuating member 15 and the spring 20.

The electrically insulating mat 14 has an opening 21 centrally thereof for accommodating a second stationary electrode 23 of hollow cylindrical shape therein, said second stationary electrode 23 having an aperture diametrically greater than the outer diameter of the projection 19. A first stationary electrode 22 is provided beneath the opening 21, and is of such a size as not to be in contact with the second stationary electrode 23.

Best Available Copy

A contact element 24 of electrically conductive elastomeric material and of solid cylindrical shape is fixedly supported in the mat 14 and is located concentrically of the first electrode 22, said contact element 24 being of a size that keeps its peripheral portion out of contact with the second electrode 23 in a non-compressed state as shown in FIG. 1. The upper face of the contact element 24 and the lower face of the moving electrode 18 oppose one another and are nearly in contact with each other.

The contact element 24 is made by dispersing fine particles of conductive metal in a mass of non-conductive elastomer such as porous or non-porous silicone rubber so that it is non-conductive in a non-compressed state but is rendered electrically conductive when pressure is imparted to compress the elastomer and the fine metal particles are brought into contact with one another.

Reference numeral 25 in FIG. 1 denotes a lead wire which is connected to the moving electrode 18 via conductive casing 11 and conductive actuating member 15, and reference numerals 26, 27 denote lead wires connected to the first and second electrodes 22, 23, respectively. The switch casing 11 and the actuating member 15 may, however, be made of electrically insulating material. In this case, a flexible lead wire is preferably connected directly to the moving electrode 18 as shown in FIGS. 2 and 3, and is led out of the switch casing 11.

Figure 2:
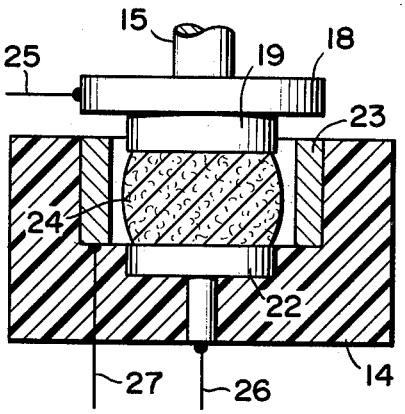
FIG. 2 is a vertical sectional front elevational view of the part of the switching apparatus in which the switching action is in the first stroke position.
Figure 3:
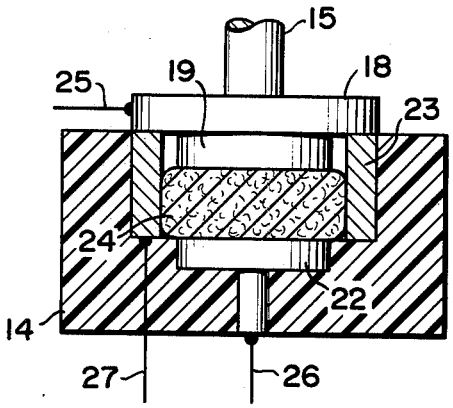
FIG. 3 is a vertical sectional front elevational view of the part of the switching apparatus in which the switching action is in the second stroke position.

Referring next to FIGS. 1, 2, and 3, the operation of the switching apparatus described heretofore will be explained for a better understanding of the present invention.

The contact element 24 is shown in FIG. 1 to be in a non-compressed state, so that the moving electrode 18 and the first electrode 22 make no electrical connection with each other, even though the contact element 24 is in contact with the moving element 18. When the actuating member 15 is depressed against the tensioning force of the spring 20, it compresses the contact element 24 axially thereof through the moving electrode 18 to be rendered conductive, as shown in FIG. 2. At this stage or first stroke, the contact element 24 is not in contact with the second electrode 23.

As shown in FIG. 3, when the actuating member 15 is further compressed, it is enlarged in the radial direction thereof. By this second stroke action, the enlarged peripheral portion of the contact element 24 is brought into contact with the inner peripheral portion of the second electrode 23 opposite it for finalizing a current path between the first and second electrodes 22, 23, thereby turning on the switch. The actuating member 15 is therefore held from further depression at this second stage.

The contact element 24 thus compressed and rendered conductive by the first stroke action performs a first switching action operative to make an electrical connection between the moving electrode 18 and the first electrode 22. The contact element 24 further compressed by the second stroke action performs a second switching action operative to make an electrical connection between the first and second electrodes 22, 23 through the moving electrode 18.

The moving electrode 18 and the second electrode 23 are shown in contact with each other in FIG. 3, but it should be noted that the object of the present invention can be attained otherwise than shown in FIG. 3.

The switching apparatus provided according to the present invention takes advantage of the electrical property and compressible deformation property of the contact element 24 to achieve a two-stroke switching action employing an actuating member 15 of simple construction and of a shortened stroke.

It is therefore advantageous from the economical, safety and reliability aspects since it can be manufactured at low costs, and can assure reliable switching action.

We claim:

1. A switching apparatus operative to complete at least two different circuit paths in a predetermined operating sequence comprising a holder fixedly attached to a cylindrical stem member, electrical insulating means supported by said holder and defining an opening of hollow cylindrical shape positioned in coaxial relation to said stem member adjacent one end of said stem member, a first stationary electrode disposed at the end of said cylindrical opening remote from said one end of said stem member, a first terminal connected to said first electrode for connecting said first electrode to an external circuit, a second stationary electrode of cylindrical shape disposed along the sidewall portion of said cylindrical opening, said second electrode being positioned in spaced, electrically separate relationship to said first stationary electrode, a second terminal connected to said second electrode for connecting said second electrode to an external circuit, a cylindrical contact element disposed within said cylindrical opening in coaxial relation thereto, said contact element comprising a compressible elastomeric material constructed to be substantially nonconductive in its noncompressed state and to be electrically conductive when compressed, one end of said cylindrical contact element being in engagement with said first stationary electrode, the diameter of said contact element in its noncompressed state being less than the diameter of said second electrode whereby said contact element is normally maintained at a predetermined distance from said second stationary electrode, a moving electrode positioned adjacent the other end of said contact element for movement along the axial direction of said contact element to axially compress said contact element, a third terminal connected to said moving electrode for connecting said moving electrode to an external circuit, and an actuating member fixedly connected to said moving electrode and slidably disposed within said stem member for selectively compressing said contact element, movement of said actuating member and moving electrode toward said first electrode to a first stroke position being operative to partially compress said contact element to complete a conductive path between said first terminal and said third terminal via said contact element, the enlarged diameter of said contact element in its said partially compressed state still being less than the diameter of said second electrode to maintain an open circuit to said second terminal when said actuating element is in its first stroke position, further movement of said actuating element toward said first electrode to a second stroke position being operative to further compress said contact element and increase its diameter sufficiently to engage said second electrode thereby to complete a further conductive path between said first and second terminals via said contact element at said second stroke position of said actuating member.

2. The switching apparatus of claim 1 wherein said electrical insulating means comprises an elastic mat of electrical insulating material provided with a central opening centrally thereof for receiving at least one of said electrodes.

3. The switching apparatus of claim 1 wherein said actuating member includes spring means which normally urges said moving electrode toward a noncompressing position relative to said contact element.

4. The switching apparatus of claim 1 wherein said moving electrode includes a portion positioned to engage said second electrode when said actuating member reaches said second stroke position thereby to complete a conductive path between said second terminal and said third terminal.

5. The switching apparatus of claim 4 wherein said moving electrode portion comprises a conductive disk having a diameter at least equal to the diameter of said second electrode, said moving electrode including a further portion projecting from said first-mentioned portion and having a diameter less than that of said second electrode for imparting a compressing force to said contact element.

* * * * *